US005810225A

United States Patent [19]

Andrew

[11] Patent Number: 5,810,225

[45] Date of Patent: Sep. 22, 1998

[54] TOOL SUPPORT APPARATUS

[76] Inventor: Richard J. Andrew, 100 Cross St., Norwell, Mass. 02061

[21] Appl. No.: 756,722

[22] Filed: Nov. 26, 1996

[51] Int. Cl.[6] ..... A45F 5/00

[52] U.S. Cl. ..... 224/271; 224/272; 224/930; 248/77

[58] Field of Search ..... 224/272, 271, 224/270, 930; 248/77, 79, 56

[56] References Cited

U.S. PATENT DOCUMENTS

| | | | |
|---|---|---|---|
| 256,163 | 4/1882 | Regan | 248/77 |
| 3,156,388 | 11/1964 | Simmons | 224/270 X |
| 4,624,429 | 11/1986 | Miyazaki | 248/56 |
| 4,830,244 | 5/1989 | Brannon | 224/103 |
| 4,977,860 | 12/1990 | Harwell | 119/109 |
| 5,050,786 | 9/1991 | DeMott | 224/253 |
| 5,052,603 | 10/1991 | Spina | 224/270 |
| 5,100,037 | 3/1992 | Kopyta et al. | 224/245 |
| 5,201,445 | 4/1993 | Axelman | 224/197 |
| 5,232,186 | 8/1993 | Unger | 224/151 |
| 5,248,072 | 9/1993 | Jones | 224/247 |

*Primary Examiner*—Renee S. Luebke

*Attorney, Agent, or Firm*—Jenkins & Wilson, P.A.

[57] ABSTRACT

A tool support apparatus is provided for supporting a hand-held tool, particularly a pneumatic tool, connected to a line, such as a pneumatic line, from a waistbelt of a user of the tool. The tool support apparatus includes a holder attachable to a waistbelt and a pivotally movable support plate attached to the holder. The support plate defines a recessed and open-sided passage therethrough for receiving an adapter attached in-line between a hand-held tool and operatively connected line. The adapter defines a central passage therethrough between opposing first and second open ends. The first open end is adapted for attachment to a hand-held tool, such as a pneumatic tool, and the second open end is adapted for attachment to a line, such as a pneumatic line, whereby the line is in gaseous communication with the tool through the central passage of the adapter. A radially outwardly extended portion is defined by the adapter adjacent the second open end and includes first and second side surfaces tapering in generally opposing directions from an outermost portion of the radially outwardly extended portion. The adapter is supportingly receivable within the recessed passage of the support plate such that the adapter must be lifted for removal from the support plate.

20 Claims, 4 Drawing Sheets

TOOL SUPPORT APPARATUS

DESCRIPTION

1. Technical Field

The present invention relates generally to apparatuses for supporting tools on a waistbelt. More particularly, the present invention relates to a novel support apparatus for supporting a hand-held tool, particularly a pneumatic tool, from a waistbelt wherein the tool has a line operatively connected thereto.

2. Related Art

Various apparatuses exist for supporting a variety of tools at the waist of a person.

While not adapted for holding a tool such as a pneumatic tool, U.S. Pat. No. 4,830,244 to Brannon discloses a fish stringer which is detachably connectable to a belt clip so as to be suspended from a user's waist. The belt clip comprises a socket including one or more detentes therein for retaining the shank of the stringer. An upset portion is positioned below the stringer shank and is utilized to retain the shank within the socket of the belt clip. The shank of the stringer can be removed from the belt clip and replaced thereon with one hand.

U.S. Pat. Nos. 3,156,388 to Simmons and 5,248,072 to Jones both disclose a tool holder attachable to a user's waist for particularly holding a hammer. The tool holder disclosed by U.S. Pat. No. 3,156,388 comprises a body, a pair of spaced ears projecting outwardly from the body to define a recess for receiving a tool handle, and jaws in spaced relation to the body and mounted on the ears to retain the tool in the recess. The jaws are tensioned by springs operable upon a pressure applied to one side of one of the jaws to effect release of a tool maintained within the recess. The tool holder disclosed by U.S. Pat. No. 5,248,072 comprises a flat upper sleeve with two J-shaped support members descending therefrom wherein each J-shaped support member has an inner and outer vertical arm joined together by a bulb-shaped base. The inner arm descends downwardly and the outer arm descends upwardly and curves inwardly towards the inner arm forming a flexible tensioned jaw and opening adapted for receiving and releasing the head of a hammer.

U.S. Pat. No. 5,050,786 to DeMott discloses a device which is attachable to a user's belt to partially support the weight of one or more cables extending between a welding machine and a welding tool while the welding tool is in use in the user's hand. The device comprises a retractable clamp means therein that is capable of gripping one or more cables passing therethrough to substantially reduce the cable loading on a user's hand. The device utilizes a hollow upright rectangular tube for insertion of one or more cables therethrough. The clamp means comprises an elongated support arm having one end swingably attached to a transverse rod extending between side walls of the tube and another end which is swingably connected to a cable-engagement element. The support arm is normally biased by a leaf spring to force the cable-engagement element against the one or more cables within the rectangular tube with sufficient force to wedge the cables into fixed positions.

U.S. Pat. No. 5,201,445 to Axelman discloses a tool holder having a self-stabilizing swivel mount for selectively accommodating an air-driven, hand-held power tool. The tool holder comprises an article receptacle for accommodating the tool wherein the article receptacle is swivel mounted by a pivotal connection to a belt pad which can be secured to the belt of a user. The lower portion of the article receptacle comprises a substantially tubular member, and the upper portion of the article receptacle is flared outwardly to form a funnel-shaped configuration. A hook member comprising a U-shaped member must be attached to a tool for use with the tool holder wherein the hook member engages the article receptacle to suspend the hook therefrom. The article receptacle is rotationally displaceable upon weight transference, and a gravity-actuated locking mechanism is provided for securing the hook member and attached tool within the article receptacle. A tool held within the article receptacle can be removed from the tool holder with one hand.

Despite the prior art apparatuses for holding at a user's waist a tool, particularly a pneumatic tool connected to a pneumatic line, there remains room for improvement in the art for a novel support apparatus for supporting a pneumatic tool connected to a pneumatic line at a person's waist.

DISCLOSURE OF THE INVENTION

The present invention provides a tool support apparatus for supporting a hand-held tool, particularly a pneumatic tool, in a hanging position associated with a waistbelt of a user of the tool. The support apparatus comprises a holder attachable to a waistbelt wherein the holder has a movable support plate attached thereto and extending generally perpendicularly therefrom. The support plate defines a recessed and open-sided passage therethrough for receiving an adapter according to this invention.

The adapter of this invention can be utilized for in-line attachment between a hand-held tool, such as a pneumatic tool, and a line operatively connected thereto, such as a pneumatic line. The adapter is receivable within the recessed passage of the support plate wherein the adapter is supported and maintained in position even with a pneumatic line and pneumatic tool attached to the adapter. The adapter comprises opposing first and second open ends and defines a central passage therethrough between the first and second open ends. The first open end is adapted for attachment to a pneumatic tool, and the second open end is adapted for attachment to a pneumatic line whereby the pneumatic line can be in gaseous communication with the pneumatic tool. The adapter includes a radially outwardly extended portion adjacent the second open end, and the radially outwardly extended portion has a first side surface tapering from an outermost portion of the radially outwardly extended portion generally toward a middle portion of the adapter and a second side surface tapering from an opposite side of the outermost portion of the radially outwardly extended portion generally toward the second open end. In the preferred embodiment, the inner surface of the central passage adjacent to the second open end of the adapter is threaded for threadably receiving a pneumatic line therein, and the exterior of the adapter adjacent the first open end is threaded so as to be threadably receivable within a pneumatic tool.

It is therefore an object of the present invention to provide a novel support apparatus for supporting a hand-held tool, particularly a pneumatic tool, having a line, such as a pneumatic line, operatively connected thereto, from a waistbelt of a user of the pneumatic tool.

It is another object of the present invention to provide such a support apparatus which frees a user's hands while still providing ready access to the hand-held tool wherein the user does not have to substantially change body positions in order to lift the hand-held tool from the support apparatus.

It is a further object of the present invention to provide such a support apparatus which safely and securely maintains a hand-held tool, particularly a pneumatic tool, in an operable condition in place at the waist of a user to obviate any need of the user to place and remove the tool from a potentially unsafe location such as a window sill, ladder, saw horse, roof surface, or even the ground.

It is still a further object of the present invention to provide a support apparatus which can be used to support a variety of hand-held tools from a waistbelt of a user with each tool having a line operatively connected thereto.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
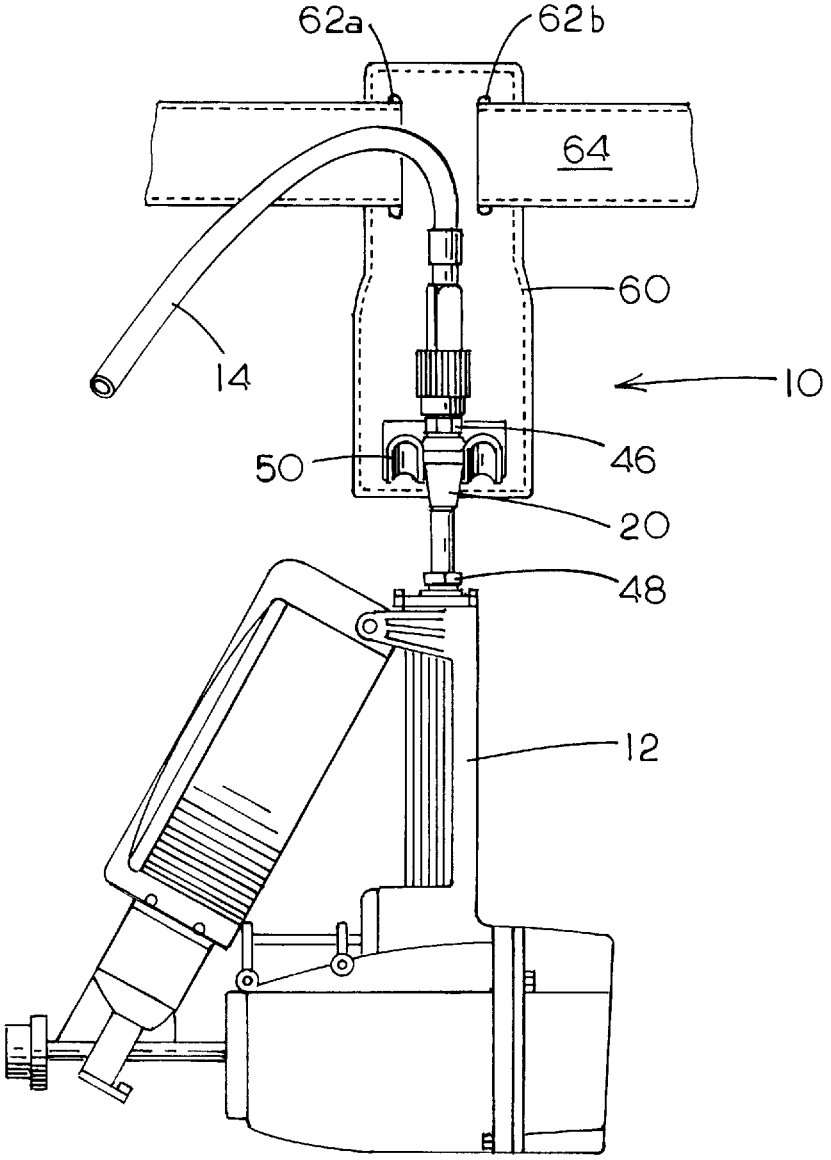
FIG. 1 of the drawings is a perspective view of the support apparatus of this invention attached to a waistbelt of a user wherein the adapter is attached in-line between a pneumatic line and a pneumatic tool and the pneumatic tool hangs from the user's waistbelt.
Figure 2:
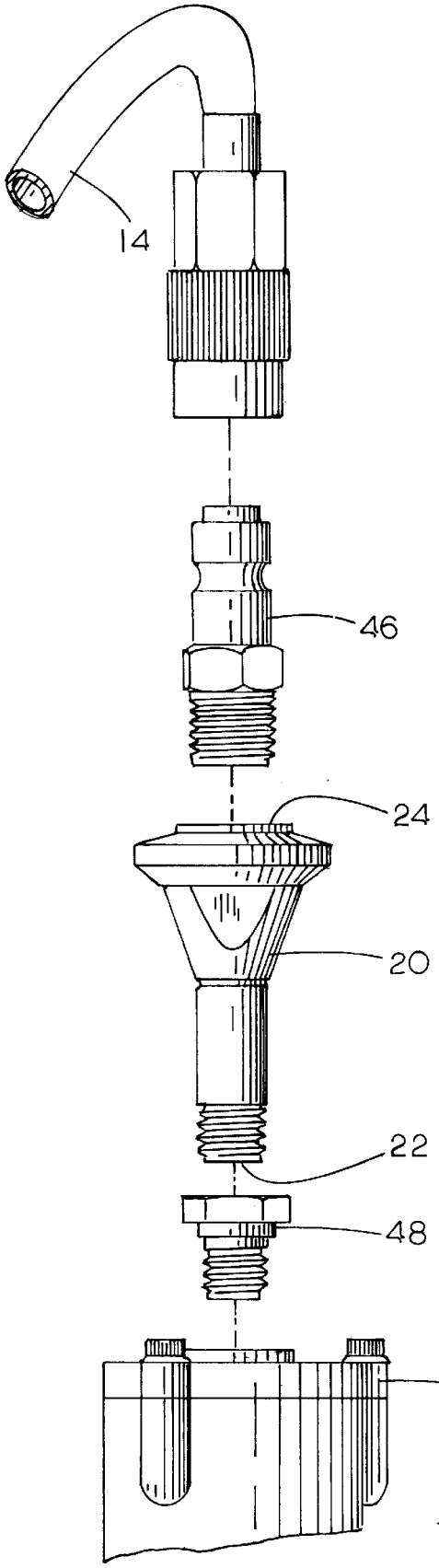
FIG. 2 of the drawings is an exploded view illustrating the adapter according to this invention and its in-line attachment between a pneumatic line and a pneumatic tool.

Referring to FIGS. 1 and 2 of the drawings, the support apparatus, generally designated 10, of this invention is shown supporting and maintaining a pneumatic tool 12 at the waist of a person. Pneumatic tool 12 can be of any conventional type, such as an air nailer or air stapler, utilizing a conventional pneumatic line 14 typically connected to a compressor (not shown) for pneumatically powering pneumatic tool 12. While the description provided herein with reference to the support apparatus is for use of the support apparatus with a pneumatic tool and an operatively connected pneumatic line, it is envisioned according to this invention that the support apparatus, including the adapter described herein, can be utilized in association with any conventional tool suitable for hanging from a waistbelt wherein the tool is powered by or utilizes in association therewith a line or cable for passage of material therethrough to the tool.

Support apparatus 10 of this invention utilizes an adapter 20 which is attached in-line between pneumatic line 14 and pneumatic tool 12 such that pneumatic line 14 is in gaseous communication with pneumatic tool 12 for pneumatic line 14 to be able to power pneumatic tool 12 just as if pneumatic line 14 was connected directly to pneumatic tool 12. One or more adapter connectors can be utilized on either or both ends of adapter 20 to attach adapter 20 in-line between pneumatic line 14 and pneumatic tool 12. As illustrated, adapter connector 46 is utilized to attach pneumatic line 14 to one end of adapter 20, and adapter connector 48 is utilized to attach adapter 20 to pneumatic tool 12.

Figure 6:
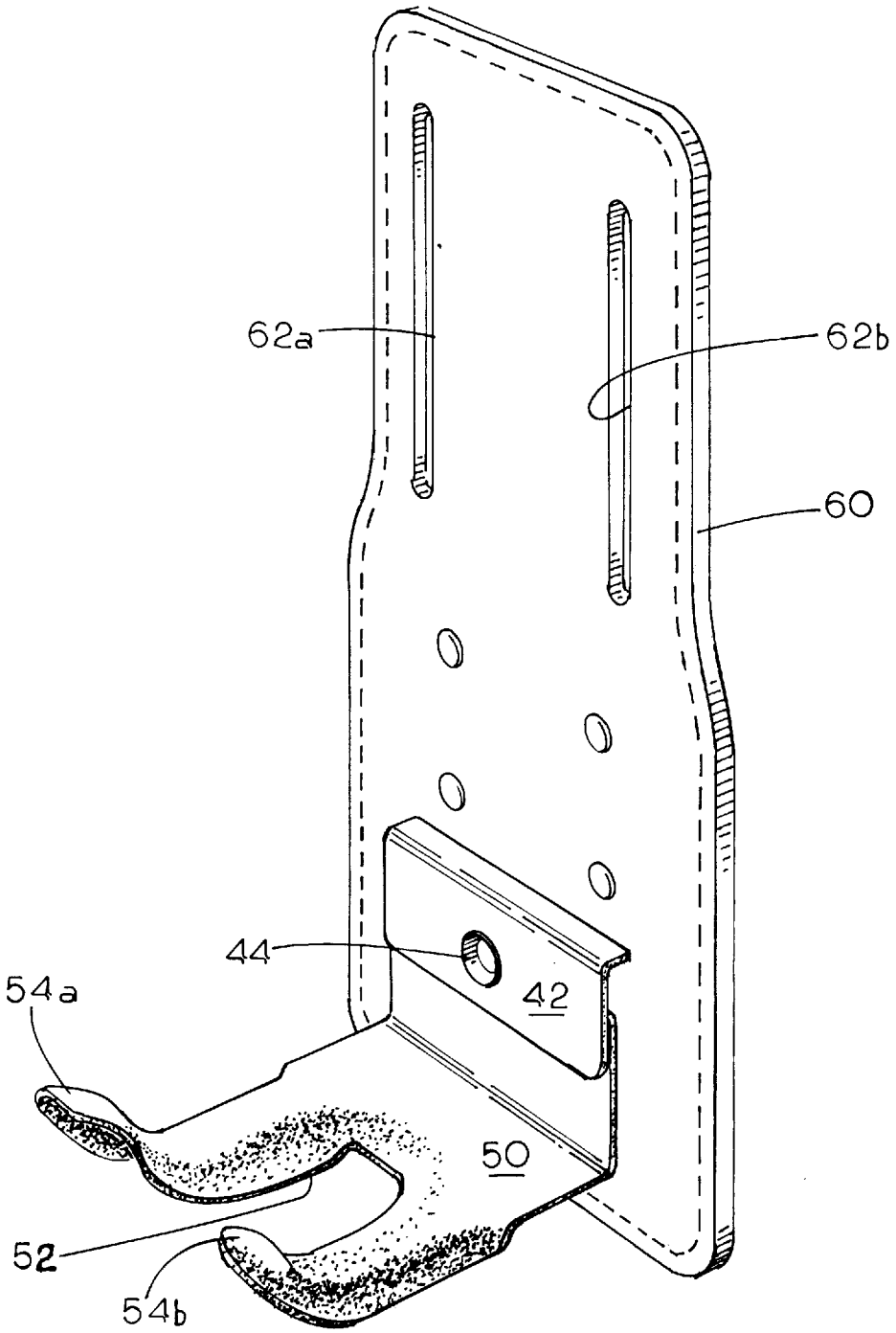
FIG. 6 of the drawings is a perspective view of the holder and support plate according to this invention.

As discussed further hereinbelow, adapter 20 is receivabe within support plate 50 attached to holder 60. As best illustrated in FIG. 6, holder 60 preferably supports base plate 42 in a substantially parallel position to holder 60 and support plate 50 is movably attached to base plate 42 by a rivet 44. A pair of slots 62A and 62B are preferably defined by holder 60 for receiving a waistbelt 64 so that holder 60 can be slidably secured to waistbelt 64.

Figure 3:
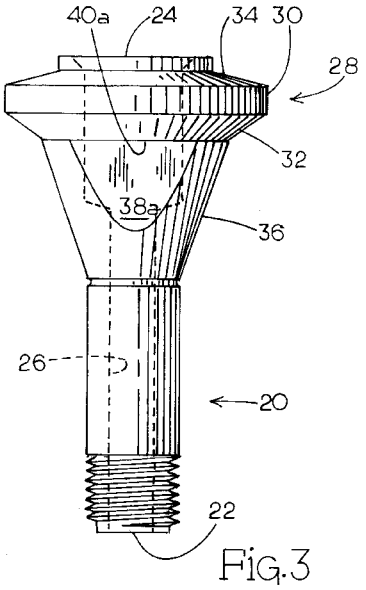
FIG. 3 of the drawings is a side elevational view of the adapter according to this invention.
Figure 4:
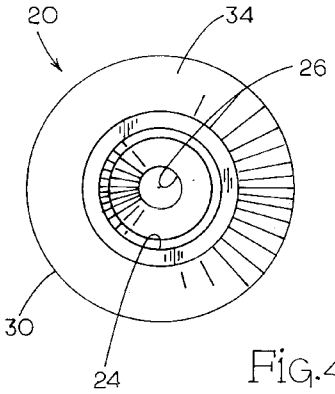
FIG. 4 of the drawings is a bottom end or plan view of the adapter according to this invention.
Figure 5:
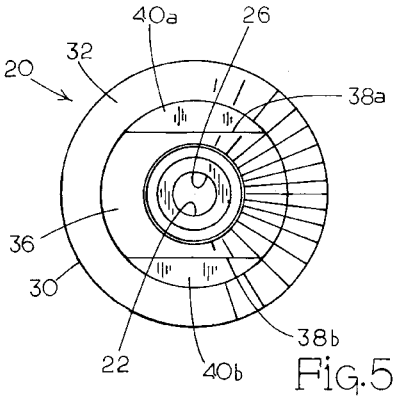
FIG. 5 of the drawings is a top end or plan view of the adapter according to this invention opposite the view shown in FIG. 4.

Referring now to FIGS. 3, 4 and 5 of the drawings, adapter 20 is shown and is generally cylindrical and comprises opposing first and second open ends 22 and 24 and a central passage 26, which is preferably cylindrical, defined through the longitudinal axis of adapter 20 between first and second open ends 22 and 24. First open end 22 is adapted for attachment to a pneumatic tool and second open end 24 is adapted for attachment to a pneumatic line whereby the pneumatic line is in gaseous communication with the pneumatic tool through central passage 26. In the preferred embodiment, the exterior of adapter 20 adjacent first open end 22 is preferably threaded so as to be threadably receivable within a pneumatic tool. The inner surface of central passage 26 adjacent second open end 24 is also threaded for threadably receiving and engaging a pneumatic line therein.

Adapter 20 has a radially outwardly extended portion (best illustrated in FIG. 3) generally designated 28 having a substantially flat outermost radial surface 30. Radially outwardly extended portion 28 is adjacent second open end 24 and adapted for receipt of at least a portion thereof within a recessed area of support plate 50 defining a passage or slot as described further hereinbelow. In its preferred embodiment, radially outwardly extended portion 28 of adapter 20 includes a first side surface 32 which tapers at an angle as it reduces in diameter from outermost surface 30 of radially outwardly extended portion 28 back to a narrower portion of adapter 20 in a general direction of first open end 22 which is generally opposite from second end 24. Radially outwardly extended portion 28 further includes a second side surface 34 extending at an angle substantially similar to that of first side surface 32, but in a generally opposite direction, and gradually tapering and decreasing in diameter from an opposite side of outermost surface 30 of radially outwardly extended portion 28 back to a narrower portion of adapter 20 generally toward second open end 24.

Below radially outwardly extended portion 28 more proximate the middle of adapter 20, a tapered section 36 exists which intersects with first side surface 32 at the area of greatest diameter of tapered section 36 to form an angle of greater than ninety (90) degrees. From there, tapered section 36 tapers and reduces in diameter generally toward first open end 22. Tapered section 36 extends and reduces in diameter to its area of least diameter which preferably is at least equal to or greater than the diameter of the end of adapter 20 defining first open end 22. This termination area of tapered section 36 can be at a location spaced-apart from first open end 22 as shown in FIG. 3 although it is envisioned according to this invention that tapered section 36 can extend to a location more near or even at first open end 22. To facilitate adapter 20 being receivable and able to be securely maintained within support plate 50 of support apparatus 10 according to this invention, tapered section 36 defines a pair of flat faces 38A and 38B, respectively, best illustrated in FIGS. 3 and 5, which are positioned on opposite sides of tapered section 36 and are preferably parallel to one another. Opposing outer edges of each flat face 38A and 38B intersect first side surface 32 of radially outwardly extended portion 28, and the edge of each flat face 38A and 38B between such opposing outer edges intersects flat ledges 40A and 40B, respectively, the opposite side of each intersecting first side surface 32.

While it is envisioned according to this invention that adapter 20 can be constructed of various materials, including plastic, in various sizes, adapter 20 is preferably constructed of aluminum with a hard, black heat treatment applied thereto. Adapter 20 is preferably approximately two (2) and one-half (½) inches in length and approximately one (1) and one-half (½) inches wide at its widest portion which is at radially outwardly extended portion 28.

FIG. 6 of the drawings best illustrates holder 60 and support plate 50 which can be used to support and maintain adapter 20 in position with a pneumatic tool and pneumatic line attached to adapter 20. Holder 60 can be constructed of leather and through slots 62A and 62B can be attached to any standard tool belt or common dress belt such as waistbelt 64 shown in FIG. 1. Base plate 42 is preferably constructed of stainless steel and riveted to holder 60 such that base plate 42 is substantially parallel to holder 60 in a rigid fashion. Support plate 50 is pivotally attached to base plate 42 by rivet 44 such that support plate 50 and a tool held therein is pivotally movable from approximately five (5) to ten (10) degrees. Support plate 50 defines a recessed and open-sided passage or slot 52 therethrough for receiving and maintaining adapter 20 in a hanging position from support plate 50. Support plate 50 has extended ears 54A and 54B defining recessed slot 52 therebetween for passage therethrough of a portion of adapter 20 below ledges 40A and 40B and first side surface 32 of radially outwardly extended portion 28. Once adapter 20 passes through slot 52, radially outwardly extended portion 28 can be seated at last partially within recessed slot 52 of support plate 50 even with a pneumatic line and pneumatic tool attached at opposite ends of adapter 20.

That portion of support plate 50 defining recessed slot 52 includes a top recessed surface, and adapter 20 is receivable within recessed slot 52 such that the top recessed surface of support plate 50 engages portions of first side surface 32 of radially outwardly extended portion 28 of adapter 20 as radially outwardly extended portion 28 is seated at least partially within recessed slot 52. In this manner, adapter 20 can be supported in a vertical, hanging position from and below support plate 50 and adapter 20 with a pneumatic tool and pneumatic line attached thereto can be securely maintained in a hanging position from support plate 50 as the weight of pneumatic tool further facilitates maintaining adapter 20 in position within recessed slot 52. With adapter 20 in this position, movement of a pneumatic tool attached thereto is limited as it typically can only swivel from approximately five (5) to approximately ten (10) degrees from its vertical position as allowed by the pivotal movement of support plate 50.

Removal of adapter 20 from its seated position within recessed slot 52 can advantageously only be accomplished by vertically moving adapter 20 a distance from support plate 50 sufficient for first side surface 32 of radially outwardly extended portion 28 to become unseated from recessed slot 52 of support plate 50. Once adapter 20 is vertically moved a sufficient distance above the top recessed surface of support plate 50, the appropriate portion of adapter 20 can be horizontally or even diagonally moved to pass through slot 52 of support plate 50 to exit support plate 50. As an advantageous feature of this invention, the preferred rigid attachment of first open end 22 of adapter 20 to a pneumatic tool, such as pneumatic tool 12, enables adapter 20 to be easily placed within and removed from recessed slot 52 of support plate 50 by a user grasping and moving only the pneumatic tool attached to adapter 20.

It is therefore seen that the present invention provides a novel support apparatus for supporting a pneumatic tool connected to a pneumatic line from a waistbelt of a user of the pneumatic tool. The novel support apparatus of this invention thereby frees the hands of a pneumatic tool user while still maintaining the pneumatic tool safely and securely and providing ready access to the pneumatic tool wherein the user can easily remove the pneumatic tool from the support apparatus for use.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter; and (b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end.

2. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter;

(b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end and said radially outwardly extended portion further including a second side surface tapering and reducing in diameter from said outermost portion of said radially outwardly extended portion generally toward said second open end.

3. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter;

(b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end and said radially outwardly extended portion further including a second side surface tapering and reducing in diameter from said outermost portion of said radially outwardly extended portion generally toward said second open end; and (c) said adapter further comprising a tapered section wherein said tapered section extends and reduces in diameter from said first side surface of said radially outwardly extended portion to an area of said adapter spaced-apart from said first open end.

4. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter;

(b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end; and (c) said adapter further including a tapered section which at its area of greatest diameter intersects said first side surface of said radially outwardly extended portion, said tapered section extending therefrom and reducing in diameter in a general direction of said first open end of said adapter.

5. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter;

(b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end; and (c) said adapter further including a tapered section which at its area of greatest diameter intersects said first side surface of said radially outwardly extended portion, said tapered section extending therefrom and reducing in diameter in a general direction of said first open end of said adapter.

6. An adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter;

(b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end;

(c) said adapter further including a tapered section which at its area of greatest diameter intersects said first side surface of said radially outwardly extended portion, said tapered section extending therefrom and reducing in diameter in a general direction of said first open end of said adapter; and (d) wherein said first side surface of said radially outwardly extended portion and said tapered section form an angle of greater than approximately ninety (90) degrees.

7. A combination adapter and pneumatic tool comprising an adapter for in-line attachment between a pneumatic tool and a line operatively connected thereto whereas said adapter is receivable within a support plate to support the pneumatic tool therefrom, said adapter comprising:

(a) a central passage defined through said adapter between opposing first and second open ends, said first open end adapted for attachment to a pneumatic tool and said second open end adapted for attachment to a line for operative connection with the pneumatic tool whereby the line is in gaseous communication with the tool through said central passage of said adapter: and (b) a radially outwardly extended portion adjacent said second open end of said adapter, said radially outwardly extended portion being adapted for being at least partially received within a recessed and open-sided passage of a support plate such that said adapter and a pneumatic tool connected thereto can be supported by the support plate, said radially outwardly extended portion including a first side surface tapering and decreasing in diameter from an outermost portion of said radially outwardly extended portion to a more narrow portion of said adapter in a general direction of said first open end;

wherein said first open end of said adapter is attached to said pneumatic tool and said second open end is attached to a pneumatic line whereby the pneumatic line is in gaseous communication with the pneumatic tool through said central passage of said adapter.

8. The combination of claim 7 wherein said first open end of said adapter is attached to said pneumatic tool by a first adapter connector and said second open end is attached to said pneumatic line by a second adapter connector.

9. A combination adapter and support apparatus comprising an adapter for in-line attachment between a hand-held tool and a line operatively connected thereto whereas said adapter is receivable within a support plate to support the hand-held tool therefrom, said adapter comprising:

(a) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter; and (b) a radially outwardly extended portion adjacent said second open end of said adapter, said radially outwardly extended portion being adapted for being at least partially received within a recessed and open-sided passage of a support plate such that said adapter and a hand-held tool connected thereto can be supported by the support plate, said radially outwardly extended portion including a first side surface tapering and decreasing in diameter from an outermost portion of said radially outwardly extended portion to a more narrow portion of said adapter in a general direction of said first open end;

wherein said adapter is received within said support apparatus, said adapter being positioned and maintained within a recessed and open-sided passage defined by and through a support plate of said support apparatus whereby said support apparatus supports said adapter.

10. The combination of claim 9 wherein said support plate of said support apparatus is pivotally movable such that said support plate can pivotally move less than approximately ten (10) degrees from a horizontal position.

11. The combination of claim 9 wherein said first open end of said adapter is attached to a pneumatic tool and said second open end of said adapter is attached to a pneumatic line.

12. The combination of claim 9 wherein said support apparatus further comprises a waistbelt to which said support plate is operatively connected.

13. The combination of claim 9 wherein said recessed and open-sided passage of said support plate comprises a recessed top surface substantially matingly engaging at least a portion of said radially outwardly extended portion of said adapter.

14. An adapter for in-line attachment between a hand-held tool and a line operatively connected thereto whereas said adapter is receivable within a support plate to hang the hand-held tool therefrom, said adapter comprising:

(a) a central passage defined through said adapter between opposing first and second open ends, said first open end adapted for attachment to hand-held tool and said second open end adapted for attachment to a line for operative connection with the hand-held tool whereby the line is in gaseous communication with the tool through said central passage of said adapter;

(b) a radially outwardly extended portion adjacent said second open end, said radially outwardly extended portion being adapted for being at least partially received within a recessed passage of a support plate such that said adapter and a hand-held tool connected thereto can be supported by the support plate, said radially outwardly extended portion comprising:

(i) a first side surface tapering and decreasing in diameter from an outermost portion of said radially outwardly extended portion in a general direction of said first open end;

(ii) a second side surface tapering and reducing in diameter from said outermost portion of said radially outwardly extended portion generally toward said second open end; and (c) a tapered section which at its area of greatest diameter intersects said first side surface of said radially outwardly extended portion, said tapered section extending therefrom and reducing in diameter in a direction generally toward said first open end, said tapered section defining at least a pair of substantially flat and parallel, opposing faces, each of which intersects said radially outwardly extended portion of said adapter.

15. A support apparatus for supporting a hand-held tool in a hanging position therefrom, said support apparatus comprising:

(a) a holder;

(b) a support plate attached to said holder, said support plate defining a recessed and open-sided passage therethrough;

(c) an adapter for in-line attachment between a hand-held tool and a line operatively connected thereto, said adapter being supportingly receivable within said recessed passage of said support plate such that said adapter must be lifted for removal from said support plate, said adapter comprising:

(i) a central passage defined through said adapter between opposing first and second open ends, said first open end adapted for attachment to a hand-held tool and said second open end adapted for attachment to a line for operative connection with the hand-held tool whereby the line is in gaseous communication with the tool through said central passage of said adapter; and (ii) a radially outwardly extended portion adjacent said second open end, said radially outwardly extended portion being adapted for being at least partially received within a recessed passage of a support plate such that said adapter and hand-held tool connected thereto can be supported by the support plate.

16. The support apparatus of claim 15 wherein said radially outwardly portion of said adapter is seated at least partially within said recessed passage of said support plate when said adapter is received within said recessed passage.

17. The support apparatus of claim 15 wherein said adapter is receivable within said recessed passage of said support plate such that at least a portion of said radially outwardly extended portion must be unseated from said recessed passage of said support plate for removal of said adapter from said recessed passage.

18. The support apparatus of claim 15 wherein said first open end of said adapter is attached to a pneumatic tool and said second open end of said adapter is attached to a pneumatic line whereby said line is in gaseous communication with the pneumatic tool through said central passage of said adapter.

19. The support apparatus of claim 18 wherein said adapter is received within said recessed passage of said support plate whereby said adapter with said pneumatic tool attached thereto hangs from said support plate.

20. The support apparatus of claim 15 wherein said holder is attachable to a waistbelt.

* * * * *